US011091931B2

(12) United States Patent
Li et al.

(10) Patent No.: US 11,091,931 B2
(45) Date of Patent: Aug. 17, 2021

(54) FENCE FRAME AND FENCE SYSTEM

(71) Applicant: HEFEI WISDOM BRIDGE INFORMATION TECHNOLOGY CO., LTD., Anhui (CN)

(72) Inventors: Ruomei Li, Anhui (CN); Kan Shi, Anhui (CN)

(73) Assignee: HEFEI WISDOM BRIDGE INFORMATION TECHNOLOGY CO., LTD., Hefei (CN)

( * ) Notice: Subject to any disclaimer, the term of this patent is extended or adjusted under 35 U.S.C. 154(b) by 0 days.

(21) Appl. No.: 17/138,872

(22) Filed: Dec. 30, 2020

(65) Prior Publication Data

US 2021/0115695 A1 Apr. 22, 2021

Related U.S. Application Data

(63) Continuation of application No. PCT/CN2019/109777, filed on Sep. 30, 2019.

(51) Int. Cl.
*E04H 17/06* (2006.01)
*E04H 17/10* (2006.01)

(52) U.S. Cl.
CPC ..... *E04H 17/06* (2013.01); *E04H 17/124* (2021.01)

(58) Field of Classification Search
CPC ..... E04H 17/14; E04H 17/16; E04H 17/161; E04H 17/163; E04H 17/02; E04H 17/04; E04H 17/05; E04H 17/10; E04H 17/12; E04H 17/124; B62B 1/00; B62B 1/10; B62B 1/12; B62B 5/00
See application file for complete search history.

(56) References Cited

U.S. PATENT DOCUMENTS 1,130,287 A * 3/1915 Horvath ..... E04H 17/16 256/24
6,151,852 A * 11/2000 Linn ..... E04H 17/163 256/24
6,536,502 B2 * 3/2003 Britto ..... E06B 9/08 160/23.1

(Continued)

FOREIGN PATENT DOCUMENTS

CN 205330278 U 6/2016
CN 106013950 * 10/2016

(Continued)

*Primary Examiner* — Jonathan P Masinick

(57) ABSTRACT

Disclosed a fence frame and a fence system. The fence frame includes a framework, wheel bodies rotatably connected to two sides of the bottom of the framework, and a plurality of storage racks movably arranged on the end surface of the framework. A fixed net is arranged in the framework, and one side wall of the framework is provided with a connecting net. The wheel bodies can be horizontally/vertically fixed on the bottom of the framework. The fence system is mainly composed of the above fence frame and a plurality of fence assembly units arranged on the fence frame. The fence assembly units are detachably connected with the fence frame in sequence. The fence frame of the present invention realizes convenience in disassembling and assembling, facilitates the transfer and reuse of the assembly units; and enhances the stability of the assembly units and the overall structure.

9 Claims, 8 Drawing Sheets

(56) References Cited

U.S. PATENT DOCUMENTS

| | | | | |
|---|---|---|---|---|
| 8,387,955 | B2 * | 3/2013 | Ptacek | E04H 17/163 256/31 |
| 9,371,642 | B2 * | 6/2016 | Herbertsson | E04H 17/163 |
| 9,580,930 | B2 * | 2/2017 | Sadinsky | E04H 17/163 |
| 10,577,826 | B2 * | 3/2020 | Lohnes | E04H 17/18 |
| 2014/0145046 | A1 * | 5/2014 | Layne | E04H 12/2269 248/188.1 |
| 2018/0223561 | A1 * | 8/2018 | Howell | E01F 15/088 |
| 2019/0254241 | A1 * | 8/2019 | Woerner | E04H 17/1413 |

FOREIGN PATENT DOCUMENTS

| | | | | | |
|---|---|---|---|---|---|
| CN | 107355130 | | * | 11/2017 | |
| CN | 206971793 | U | | 2/2018 | |
| CN | 207073325 | U | | 3/2018 | |
| CN | 107964899 | | * | 4/2018 | |
| CN | 108019094 | | * | 5/2018 | |
| CN | 207397198 | U | | 5/2018 | |
| CN | 209308543 | U | | 8/2019 | |
| ES | 1231940 | Y | | 9/2019 | |
| FR | 3034449 | A1 | * | 10/2016 | E04H 17/20 |

* cited by examiner

FENCE FRAME AND FENCE SYSTEM

CROSS-REFERENCE TO RELATED APPLICATIONS

This application is a continuation of International Patent Application No. PCT/CN2019/109777, filed on Sep. 30, 2019. The content of the aforementioned applications, including any intervening amendments thereto, is incorporated herein by reference in its entirety.

TECHNICAL FIELD

The present invention relates to the technical field of electric power construction equipment, and particularly relates to a fence frame and a fence system.

BACKGROUND OF THE PRESENT INVENTION

At present, in order to meet the safety requirement in the construction or maintenance process of electric power, protective fences must be erected on construction sites so as to effectively prevent non-construction personnel from entering the construction or maintenance site of the electric power.

The existing electric power protective fence is generally composed of a left vertical bar, a right vertical bar and a protective mechanism (generally a protective net) arranged between the two vertical bars. The protective net is connected with the two vertical bars through hanging, rope fastening and the like. Although the above structure has certain warning effect, there are a lot of disadvantages in an actual application process because of structural and design limitations.

Firstly, by adopting the connection way such as hanging, rope fastening and the like, the protective net is infirm in connection and difficult to fix, and is easy to loosen and drop off, so that an ideal protection effect cannot be achieved.

Secondly, when the vertical bars and the protective net are disassembled after used, the operation is complicated, thereby wasting time and labor; and moreover, the protective net and the vertical bars are stacked and transferred after separated, which is easy to cause the problems such as intertwining and local knotting of the protective net, and is not conducive to the subsequent reuse.

Moreover, the existing structural design of the vertical bars cannot be flexibly adjusted according to the actual need so as to meet the fixation requirements of different support foundations on different sites, causing that the support stability of the vertical bars cannot be guaranteed.

Finally, the vertical bars, the protective net and other fence assembling components need to be carried manually or provided with a transfer trolley so as to realize the transfer between different sites. By adopting the manual carrying way, the workload is heavy, and the working efficiency is low. When the transfer trolley is used for carrying, after the transfer operation is completed, the transfer trolley is in idle, which occupies a certain space and requires special storage, thereby increasing the cost.

The above greatly reduces the application performance and application range of the electric power protective fence. Therefore, it is urgent to design a novel fence system to solve the above problems.

SUMMARY OF THE PRESENT INVENTION

The technical problem to be solved by the present invention is to provide a fence frame and a fence system. The fence frame has double functions of a transfer trolley and a fence system component. The fence system is composed of a plurality of assembly units that are detachably connected in sequence, thereby being convenient to disassemble and assemble. The fence system has an automatic winding function, thereby facilitating the transfer and reuse of the assembly units. The fence system can meet the ground fixation requirements of different working sites, and enhances the stability of the assembly units and the overall structure.

To solve the above technical problems, the present invention adopts a technical solution as follows: a fence frame includes a framework, wheel bodies rotatably connected to two sides of the bottom of the framework, and a plurality of storage racks movably arranged on the end surface of the framework.

A fixed net is arranged in the framework, and one side wall of the framework is provided with a connecting net.

The wheel bodies can be horizontally/vertically fixed on the bottom of the framework.

Further, the storage racks are arranged symmetrically on two end surfaces of the framework.

Further, each of the storage racks includes a crossbeam plate fixed on the end surface of the framework and a storage plate rotatably connected to the outer side surface of the crossbeam plate.

The side surface of the crossbeam plate is provided with a carrier plate located below the storage plate.

The storage plate is provided with a plurality of storage holes.

Further, the outer end surface of each wheel body is detachably connected with a fixed plate.

Further, the bottom side surface of the framework is provided with a first positioning hole and a second positioning hole separately. A positioning pin is plugged in the first positioning hole/the second positioning hole, which is used for fixing the wheel body on a horizontal/vertical position.

Further, the side edge of the connecting net away from the framework is provided with a plurality of first plugging buckles. Two side surfaces of the framework are respectively provided with first plugging bayonets matched with the first plugging buckles.

A fence system is also provided, which is mainly composed of the above fence frame and a plurality of fence assembly units arranged on the fence frame. The fence assembly units are detachably connected with the fence frame in sequence.

Further, each of the fence assembly units includes a base, a bar body rotatably sleeved on the top of the base and a net body wound on the bar body.

The outer side edge of the net body is provided with a plurality of second plugging buckles.

Further, the top of the base is provided with a winding apparatus. The winding apparatus drives the bar body to rotate, so that the net body is wound on the bar body.

Further, the side wall of the bar body is provided with a plurality of second plugging bayonets corresponding to the second plugging buckles.

The present invention has the beneficial effects as follows:

1. In the fence frame of the present invention, by changing the position state of the wheel bodies, the fence frame has double functions of a transport device and the fence system component and is simple in operation and convenient to use, so that the fence system needs no transfer equipment in the transfer process, thereby reducing the device investment and achieving good economical performance and good practicability.

2. The fence system of the present invention adopts an assembling mode in which a plurality of assembly units are connected by the buckles, thereby realizing convenience in assembling and disassembling and greatly increasing the working efficiency for constructing the protective net.

3. The fence assembly units of the present invention are provided with the winding apparatus which drives the outer bar body to rotate so as to realize the automatic winding of the net body, thereby facilitating the disassembling and storage operation of the protective net, effectively avoiding the random intertwining of the net bodies and facilitating the reuse.

3. The fence assembly units of the present invention can meet the ground fixation requirements of different working sites by installing a fixed assembly that can be folded for storage and unfolded for fixation in the base, thereby enhancing the stability of the assembly units and the overall structure, reducing the tilting and falling probability caused by an external force such as wind force, and achieving good practicability.

Figure 1:
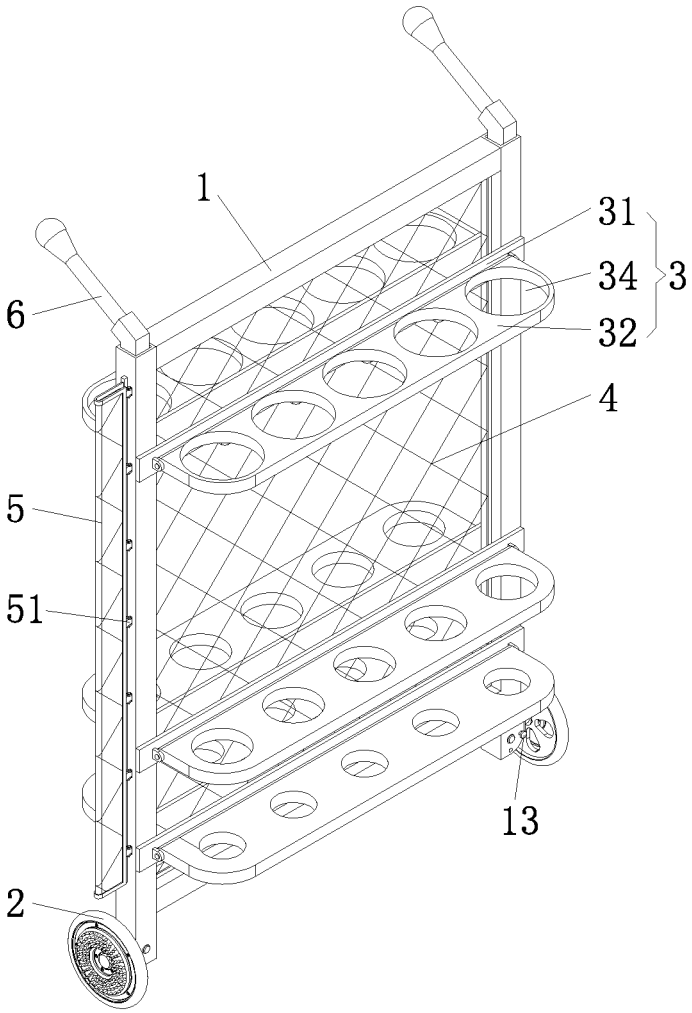
FIG. 1 is a three-dimensional structural schematic diagram of a fence frame in a moving state according to the present invention.

In the drawings: 1—framework; 11—first positioning hole; 12—second positioning hole; 13—first plugging bayonet; 2—wheel body; 21—fixed plate; 22—spike; 23—positioning block; 24—pin hole; 3—storage rack; 31—crossbeam plate; 32—storage plate; 33—carrier plate; 34—storage hole; 4—fixed net; 5—connecting net; 51—first plugging buckle; 6—handrail; 7—fence assembly unit; 71—bar body; 711—second plugging bayonet; 72—net body; 73—second plugging buckle; 74—base; 741—second connecting boss; 742—embedding opening; 743—threaded hole; 75—winding apparatus; 751—driving unit; 752—electric motor; 753—rotating disc; 76—wire protection sleeve; 761—wiring groove; 77—anchor tip housing; 78—fixed assembly; 781—compression spring; 782—movable plate; 783—fixed claw; 79—top cover; 791—first connecting boss.

DETAILED DESCRIPTION OF THE PRESENT INVENTION

Preferred embodiments of the present invention are described in detail below in conjunction with the drawings to make the advantages and features of the present invention more easily understood by those skilled in the art, so as to define the protection scope of the present invention more clearly.

Figure 2:
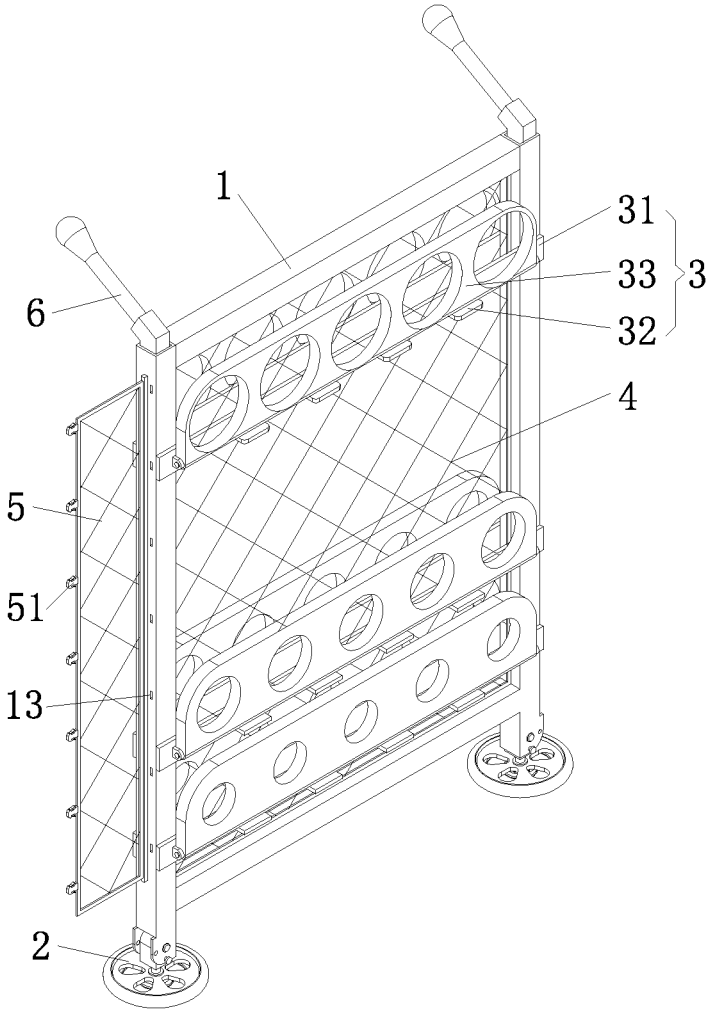
FIG. 2 is a three-dimensional structural schematic diagram of the fence frame in a fixed state according to present invention.

Referring to FIG. 1 and FIG. 2, a fence frame includes a framework 1, wheel bodies 2 rotatably connected to two sides of the bottom of the framework 1, and storage racks 3 movably arranged on the end surface of the framework 1. The framework 1 is of a square framework structure formed by connecting square profile steel or bolts.

The storage racks 3 are arranged symmetrically on two end surfaces of the framework 1. Each end surface is provided with an upper layer, middle layer and lower layer of storage racks 3. Each of the storage racks 3 includes a crossbeam plate 31 fixed on the end surface of the framework 1 and a storage plate 32 rotatably connected to the outer side surface of the crossbeam plate 31. Two ends of the crossbeam plate 31 are connected onto the end surfaces of a left stand column and a right stand column of the framework 1 in a welding manner or by bolts. Two ends of the outer side surface of the crossbeam plate 31 are respectively provided with a rotating shaft seat. Two ends of each storage plate 32 are in damping rotating connection with the rotating shaft seat, so that the storage plate 32 can be overturned between a horizontal position and a vertical position and can be positioned on any position within the rotating range. Preferably, the side surface of the crossbeam plate 31 is provided with a carrier plate 33 located below the storage plate 32, so that when the storage plate 32 is overturned to a horizontal state, the storage plate 32 is in lap joint with the top surface of the carrier plate 33 to be positioned.

Each storage plate 32 is provided with four storage holes 34. The storage holes 34 on the upper, middle and lower layer storage racks 3 are same in quantity and are correspondingly arranged in the vertical direction. The aperture of the storage holes 34 is successively reduced from top to bottom.

A fixed net 4 is arranged in the framework 1. Four inner walls of the framework 1 are respectively connected with a pressing plate by bolts to fixedly connect four edges of the fixed net 4. The side wall of the left stand column of the framework 1 is provided with a connecting net 5. A vertical edge at the inner side of the connecting net 5 is detachably connected onto the side wall of the left stand column through the pressing plate connected onto the side wall of the left stand column through the bolt. The side edge of the connecting net 5 away from the framework 1 is provided with a plurality of first plugging buckles 51 that are uniformly distributed in the vertical direction. The side surfaces of the left stand column and the right stand column of the framework 1 are respectively provided with first plugging bayonets 13 matched with the first plugging buckles 51. The first plugging buckle 51 adopts a plastic strap buckle, which is convenient for the connection with and disassembling from the first plugging bayonet 13.

Figure 3:
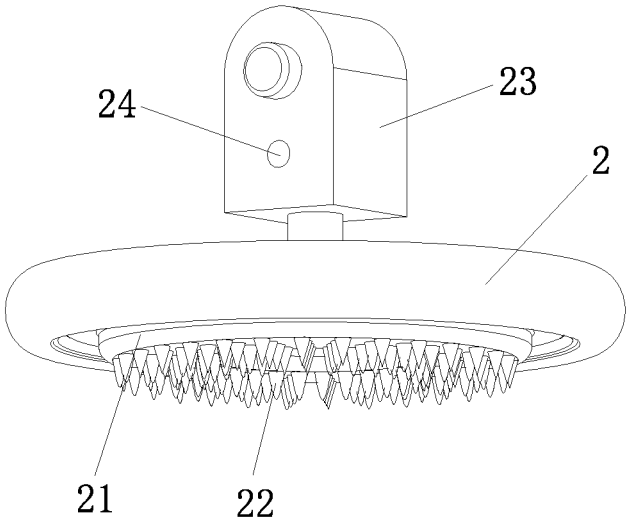
FIG. 3 is a three-dimensional structural schematic diagram of a wheel body.
Figure 4:
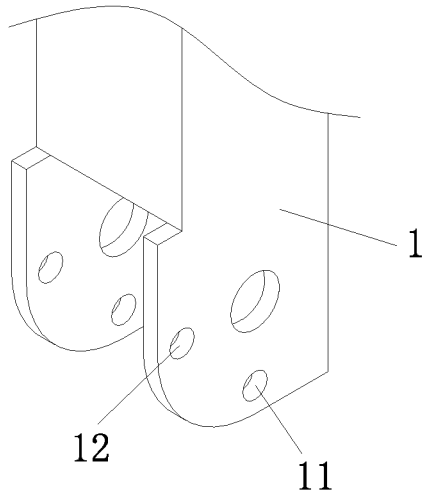
FIG. 4 is a local structural schematic diagram of a framework bottom.

As shown in FIG. 3, the end portion of a rotating shaft of the wheel body 2 is rotatably connected with a positioning block 23. The positioning block 23 is in shaft connection to the bottom of the framework 1, so that the wheel body 2 can be switched between a horizontal position and a vertical position. As shown in FIG. 4, the bottom side surfaces of the framework 1 are respectively provided with a first positioning hole 11 and a second positioning hole 12 separately. A positioning pin is inserted in the first positioning hole 11/the second positioning hole 12 for fixing the wheel body 2 on the horizontal/vertical position, that is, a central angle between the center of the first positioning hole 11, the center of the second positioning hole 12 and the center of the rotating shaft of the positioning block 23 is 90°, and the second positioning hole 12 is located right below the rotating shaft of the positioning block 23. The side surface of the positioning block 23 is provided with a pin hole 24 used for plugging the positioning pin. Namely, when the pin hole 24 is overlapped with the first positioning hole 11, the positioning pin is plugged into the pin hole 24 and the first positioning hole 11, and the wheel body 2 is in a perpendicular state and is located on a side portion of the framework 1 to serve as a conventional wheel, thereby facilitating the integral transfer of the fence frame. When the pin hole 24 is overlapped with the second positioning hole 12, the positioning pin is plugged into the pin hole 24 and the second positioning hole 12, so that the wheel body 2 is in a horizontal state and is located on the bottom of the framework 1 to serve as a conventional support base, thereby facilitating the integral fixation of the fence frame on the support foundation (such as the ground).

Preferably, the outer end surface of the wheel body 2 is detachably connected with a fixed plate 21. The fixed plate 21 protrudes from the end surface of the wheel body 2, so that the wheel body 2 is prevented from directly contacting the support foundation, and the support stability is also improved. Further, the surface of the fixed plate 21 is provided with a plurality of spikes 22 that are uniformly distributed so as to meet the support requirements of the uneven support foundation or the support foundation with loose matrix, and the occlusal force between the fixed plate 21 and the surface of the support foundation is increased.

Two sides of the top of the framework 1 are provided with handrails 6 respectively, thereby facilitating integral transfer operation of the fence frame.

Figure 5:
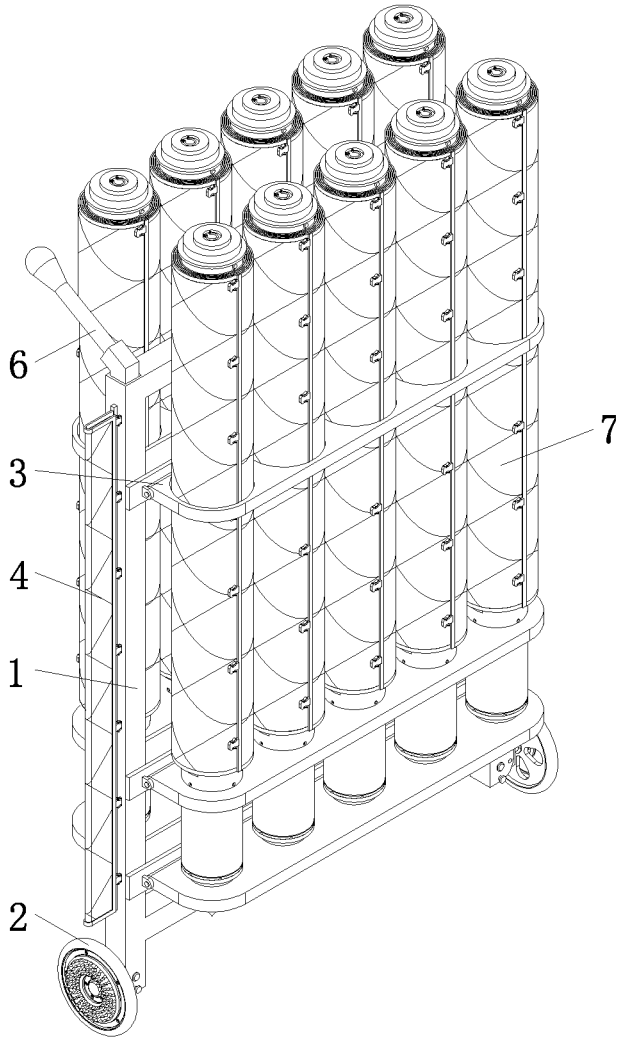
FIG. 5 is a three-dimensional structural schematic diagram of a fence system according to the present invention.

Referring to FIG. 5, a fence system is mainly composed of a fence frame and a plurality of fence assembly units 7 arranged on the fence frame. Since each storage plate 32 is provided with four storage holes 34, the single side of the fence frame can be provided with four fence assembly units 7 and two sides can be provided with eight fence assembly units 7.

Figure 6:
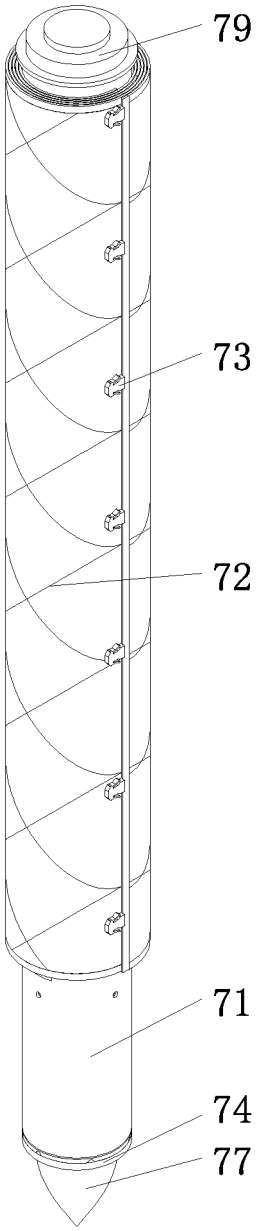
FIG. 6 is a three-dimensional structural schematic diagram of a fence assembly unit.
Figure 7:
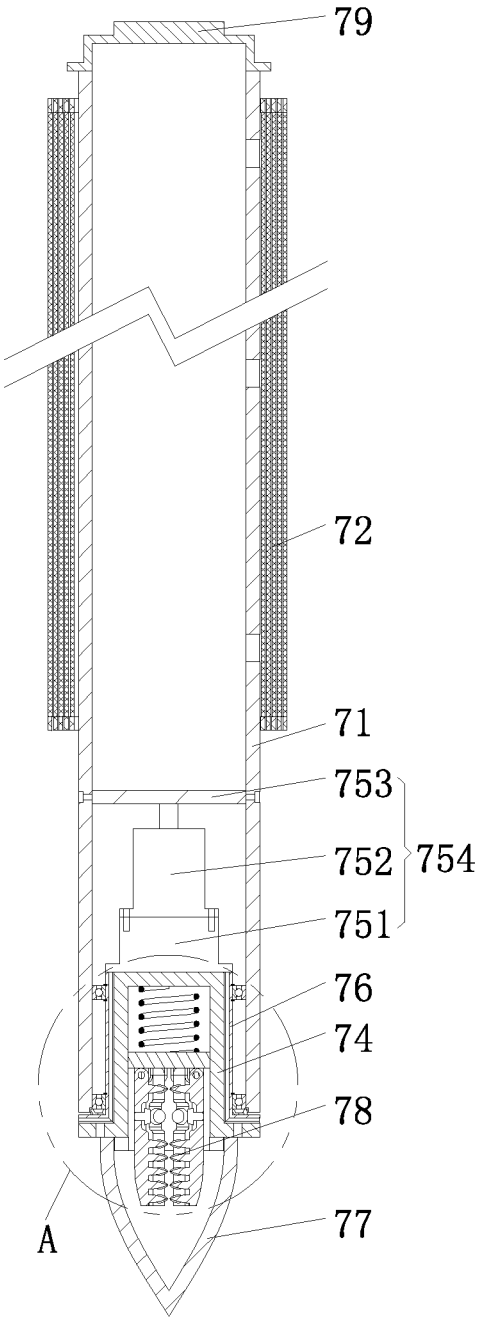
FIG. 7 is a sectional structural schematic diagram of the fence assembly unit.
Figure 8:
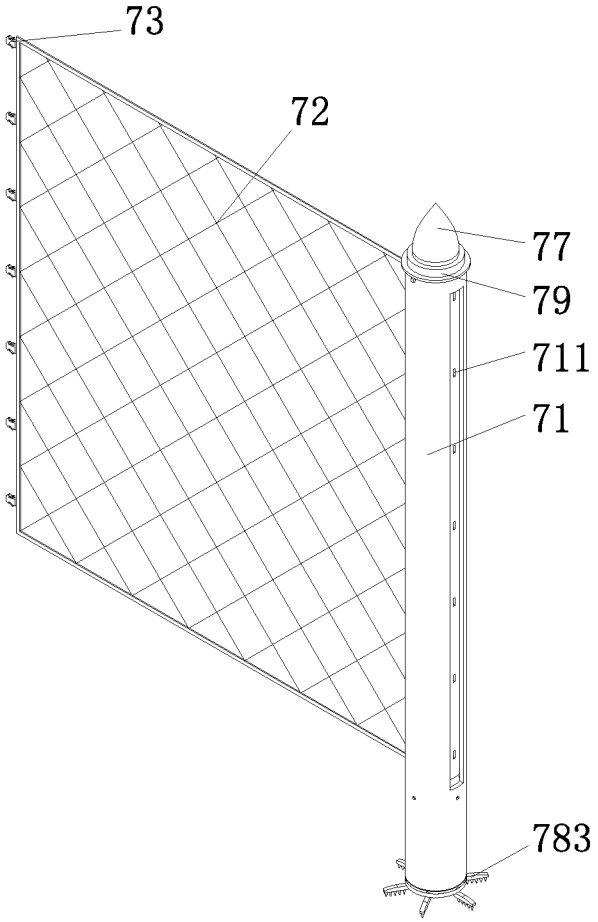
FIG. 8 is a three-dimensional structural schematic diagram of the fence assembly unit in an unfolded state.

As shown in FIG. 6 to FIG. 8, the fence assembly unit 7 includes a base 74, a bar body 71 rotatably sleeved on the base 74, and a net body 72 wound on the bar body 71. The outer side edge of the net body 72 is provided with second plugging buckles 73 having the quantity and distribution positions corresponding to those of the first plugging buckles 51. The second plugging buckles 73 and the first plugging buckles 51 adopt the same structure and model.

Figure 10:
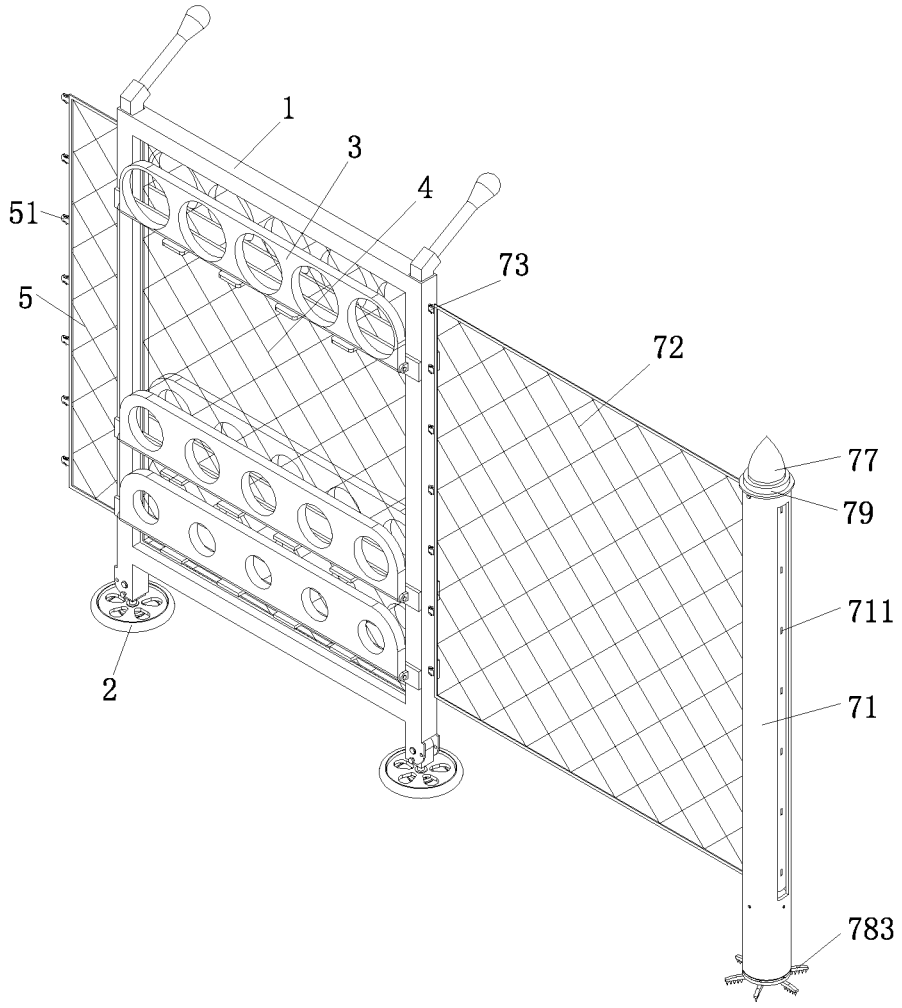
FIG. 10 is a three-dimensional structural schematic diagram of a connection state of the fence assembly unit and the fence frame.
Figure 11:
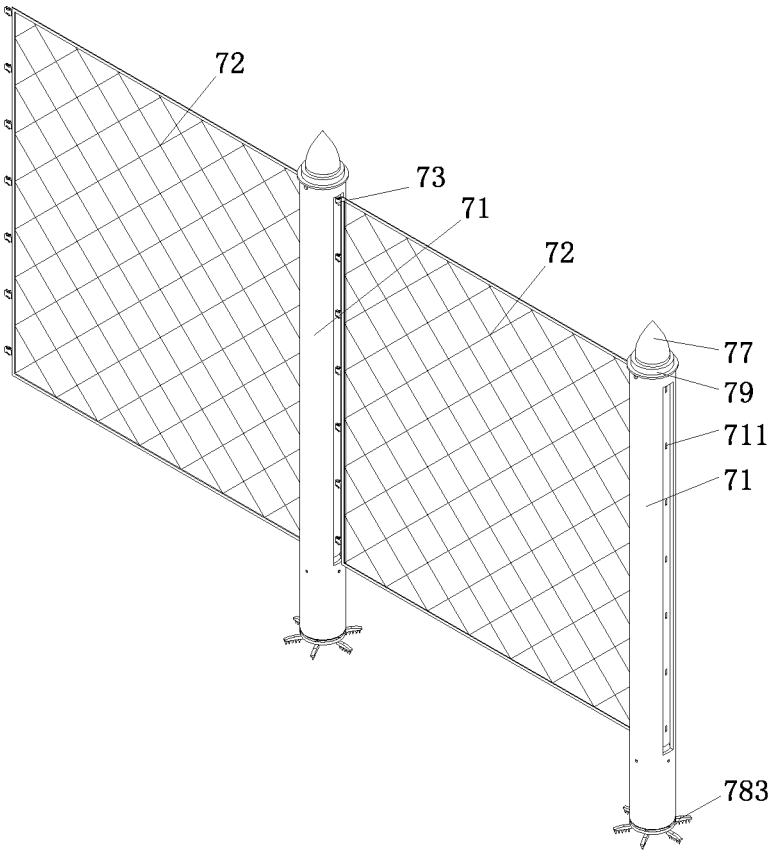
FIG. 11 is a three-dimensional structural schematic diagram of a connection state between two fence assembly units.

As shown in FIG. 10, after the net body 72 is unfolded, the second plugging buckles 73 can be buckled with the first plugging bayonets 13 on the side surface of the right stand column of the framework 1, so that the fence assembly unit 7 can be detachably connected with the fence frame. Preferably, the side wall of the bar body 71 is provided with a plurality of second plugging bayonets 711 corresponding to the second plugging buckles 73, so that the second plugging buckles 73 of the latter fence assembly unit 7 can be buckled with the second plugging bayonets 711 of the previous fence assembly unit 7, thereby completing the connection between the two fence assembly units 7, as shown in FIG. 11. The fence assembly units 7 are detachably connected with the fence frame in sequence to form a protective fence of an electric power construction site in an enclosing manner.

Figure 9:
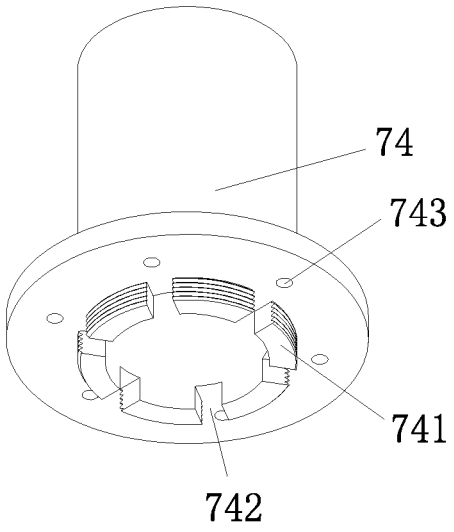
FIG. 9 is a three-dimensional structural schematic diagram of a base.

As shown in FIG. 9, the base 74 is of a cylindrical shell structure with a cross section in an inverted U shape. The bottom surface of the base 74 is provided with an annular second connecting boss 741, and a circumferential surface of the second connecting boss 741 is provided with outer threads. The side wall of the second connecting boss 741 is provided with six embedding openings 742 that are uniformly distributed.

The top of the base 74 is provided with a winding apparatus 75. The winding apparatus 75 drives the bar body 71 to rotate around the base 74. As shown in FIG. 7, the winding apparatus 75 includes a driving unit 751 fixed on the top of the base 74, an electric motor 752 fixed on the top of the driving unit 751, and a rotating disc 753 fixed on the end of an output shaft on the top of the electric motor 752. The driving unit 751 includes an electrical box, a battery pack, a controller (not shown in the drawing) and other modules, belongs to the prior art and is not described in detail herein. The battery pack adopts a rechargeable lithium battery pack.

Figure 12:
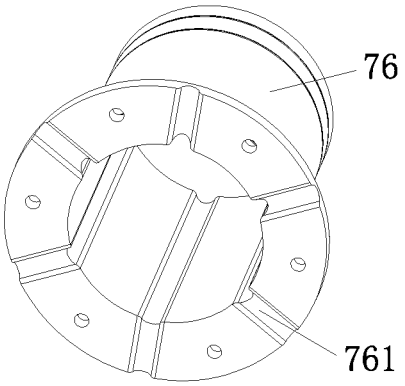
FIG. 12 is a three-dimensional structural schematic diagram of a wire protection sleeve.

Preferably, the outer side of the base 74 is sleeved with a wire protection sleeve 76. The wire protection sleeve 76 is fixedly connected with the base 74 through a bolt. As shown in FIG. 12, the inner wall and the bottom surface of the wire protection sleeve 76 are respectively provided with a communication wiring groove 761 which is used for laying and protecting switch circuits and charging circuits of the driving unit 751. The side wall of the base 74 is provided with a switch, a power supply indicator lamp and a charging interface (not shown) which are electrically connected with the driving unit 751. The switch is used to control the on/off of the electric motor 752. The power supply indicator lamp is used to display an electric quantity of the battery pack. The charging interface is used to charge the battery pack in the driving unit 751.

The bottom of the inner wall of the bar body 71 is rotatably connected to the outer side of the wire protection sleeve 76 through a bearing. The side surface of the rotating disc 753 is fixedly connected with the side wall of the bar body 71 through a bolt. The electric motor 752 drives the rotating disc 753 to rotate, so that the bar body 71 is driven to rotate around the wire protection sleeve 76, and the net body 72 is wound on the bar body 71, thereby achieving an automatic winding function. With the wire protection sleeve 76, the winding process does not cause any damage to the circuit of the winding apparatus 75.

The bottom of the base 74 is provided with an anchor tip housing 77 of a conical structure. The anchor tip housing 77 is a shell structure made of a metal material. The inner wall of the anchor tip housing is provided with inner threads that are correspondingly connected with the outer threads on the second connecting boss 741. The conical structure of the anchor tip housing 77 is convenient for integrally plugging and fixing the protective net on the loose support foundation such as wetland, sand and the like.

Figure 13:
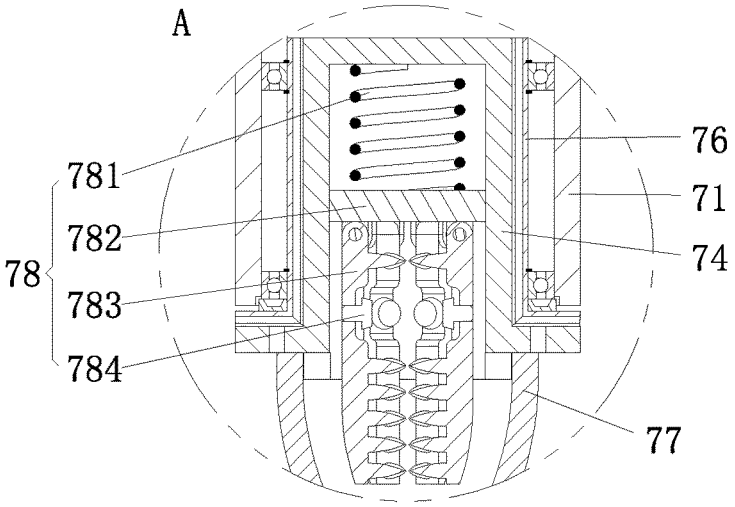
FIG. 13 is an enlarged schematic diagram of part A in FIG. 7.

The bottom inner side of the base 74 is provided with a fixed assembly 78. The fixed assembly 78 is retracted into the base 74 or unfolded and fixed on the bottom of the base 74. As shown in FIG. 13, the fixed assembly 78 includes a compression spring 781 connected to the inner top surface of the base 74, a movable plate 782 connected to the bottom end of the compression spring 781, and six fixed claws 783 rotatably connected onto the bottom surface of the movable plate 782. The side surface of the movable plate 782 slidably contacts the inner wall of the base 74, so that the six fixed claws 783 can be integrally retracted into the base 74 after being drawn close, and limited in the base 74 by the anchor tip housing 77 that is connected to the bottom of the base 74 by the threads, and the compression spring 781 is then in a compressed state.

Figure 14:
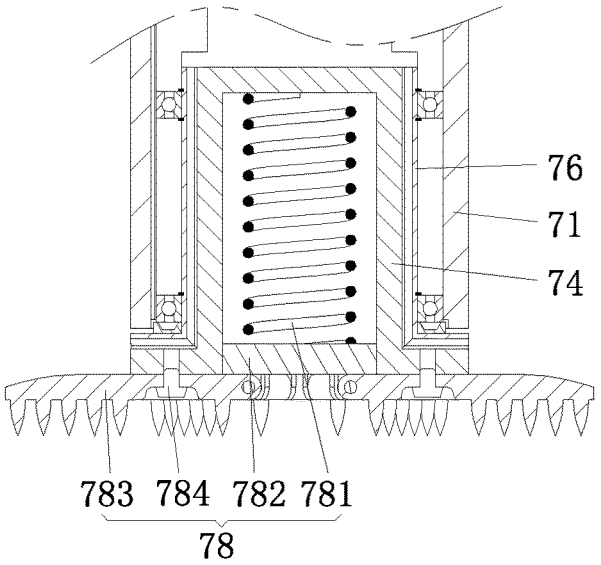
FIG. 14 is a structural schematic diagram of a fixed assembly in an unfolded state of fixed claws.

After the anchor tip housing 77 is removed from the base 74, the movable plate 782 and the six fixed claws 783 are pushed out to the bottom outer side of the base 74 under the effect of a restoration force of the compression spring 781. As shown in FIG. 14, the six fixed claws 783 are correspondingly located in the six embedding openings 742 after being unfolded outwards to a horizontal state. Preferably, the inner wall of the fixed claw 783 is provided with a fastening bolt 784. The bottom surface of the base 74 is provided with a threaded hole 743 matched with the fastening bolt 784. After the fixed claws 783 are unfolded to the horizontal state, the fixed claws 783 are fixed on the bottom of the base 74 through the threaded connection between the fastening bolt 784 and the threaded hole 743, thereby increasing a support area of the bottom of the base 74 and enhancing the overall support stability of the base 74.

Further, the inner wall/bottom surface of the fixed claw 783 is provided with a plurality of spike structures, which can effectively enhance a grasping force between the fixed claws 783 and the support foundation, thereby improving the support stability and reliability. The inner wall/bottom surface of the fixed claw 783 is provided with a groove, and the fastening bolt 784 is arranged in the groove, so that after the fastening bolt 784 is connected with the threaded hole 743 of the base 74, the fastening bolt 784 is sunken into the groove without influencing the flatness of the support surface of the fixed claw 783.

Figure 15:
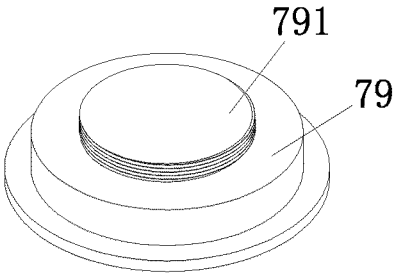
FIG. 15 is a three-dimensional structural schematic diagram of a top cover.

The top of the bar body 71 is fixedly provided with a top cover 79. As shown in FIG. 15, the top surface of the top cover 79 is provided with a first connecting boss 791. The first connecting boss 791 has the same outer diameter with the outer diameter of the second connecting boss 741 and is also provided with outer threads. After being removed from the base 74, the anchor tip housing 77 is transferred onto the first connecting boss 791 and fixed on the first connecting boss 791 through thread connection, so that the random storage or loss of the anchor tip housing 77 can be avoided.

An application process of the fence system includes the following steps:

(1) A transfer and positioning process of the fence system:

(1.1) The wheel body 2 is adjusted to a vertical state and used as the conventional wheel;

(1.2) The fence frame is pushed to move through the handrails 6, and the fence frame carries the fence assembly units 7 to a fence building site;

(1.3) The fence frame is stopped at an entrance/exit position of a fence, and then the wheel bodies 2 are adjusted to the horizontal state and fixed to the bottom of the framework 1, so that the fence frame is fixed on the support foundation;

(2) A splicing and assembling process of the fence system:

(2.1) One fence assembly unit 7 is removed from the framework 1, and the net body 72 is manually pulled to unfold;

(2.2) The second plugging buckles 73 on the net body 72 are correspondingly buckled with the first plugging bayonets 13 on the side wall of the framework 1 respectively;

(2.3) The remaining fence assembly units 7 are successively removed from the framework 1, and the net bodies 72 are gradually unfolded; the second plugging buckles 73 on the net body 72 are successively buckled with the bar body 71 of the previous fence assembly unit 7; and the first plugging buckles 51 on the connecting net 5 are buckled with the bar body 71 of the last fence assembly unit 7;

(2.4) The bar body 71 of each fence assembly unit 7 is moved to a proper position, so that after the net body 72 is in a strained state, the fixing way of the bar body 71 on the support foundation is selected according to the actual situation of the support foundation, that is, the anchor tip housing 77 is directly plugged into the support foundation or the fixed claws 783 of the fixed assembly 78 extend out and unfold on the surface of the support foundation, thereby accomplishing the position fixation of each bar body 71;

(3) A disassembling process of the fence system:

(3.1) The second plugging buckles 73/bar body 71 of each fence assembly unit 7 is separated from the bar body 71/second plugging buckles 73 of the adjacent fence assembly unit 7;

(3.2) The switch on each fence assembly unit 7 is manually turned on to start the corresponding winding apparatus 75, so that the corresponding bar body 71 is driven to rotate, and the net body 72 on each fence assembly unit 7 is automatically wound on the bar body 71; and if the extension unfolding support way of the fixed assembly 78 is adopted, the fixed assembly 78 needs to be retracted into the base 74, and the anchor tip housing 77 is connected to the bottom of the base 74;

(3.3) The fence assembly unit 7 after each net body 72 is wound is arranged on the storage rack 3, so that the anchor tip housing 77, the bar body 71 and the wound net body 72 are respectively located in the storage holes 34 of the three layers of storage plates 32;

(3.4) The first plugging buckles 51 on the connecting net 5 are buckled with the first plugging buckles 13 arranged at the same side of the framework 1;

(3.5) The wheel bodies 2 on the bottom of the framework 1 are readjusted to the vertical state and fixed at one side of the bottom of the framework 1, so that the fence frame can be pushed again to move through the handrails 6.

The above only describes the embodiments of the present invention and does not limit the patent scope of the present invention. Any equivalent structure or equivalent process transformation made by using the contents of the description and drawings of the present invention, or direct or indirect applications in other related arts shall also be included in the patent protection scope of the present invention.

What is claimed is:

1. A fence frame, comprising a framework (1), wheel bodies (2) rotatably connected to two sides of a bottom of the framework (1), and a plurality of storage racks (3) movably arranged on an end surface of the framework (1), wherein a fixed net (4) is arranged in the framework (1), and one side wall of the framework (1) is provided with a connecting net (5);

the wheel bodies (2) are horizontally or vertically fixed on the bottom of the framework (1);

a bottom side surface of the framework (1) is provided with a first positioning hole (11) and a second positioning hole (12) separately; and a positioning pin is plugged in the first positioning hole (11) and the second positioning hole (12), which is used for fixing the wheel body (2) on a horizontal or vertical position.

2. The fence frame according to claim 1, wherein the storage racks (3) are arranged symmetrically on two end surfaces of the framework (1).

3. The fence frame according to claim 1, wherein each of the storage racks (3) comprises a crossbeam plate (31) fixed on the end surface of the framework (1) and a storage plate (32) rotatably connected to the outer side surface of the crossbeam plate (31);

the side surface of the crossbeam plate (31) is provided with a carrier plate (33) located below the storage plate (32);

the storage plate (32) is provided with a plurality of storage holes (34).

4. The fence frame according to claim 1, wherein an outer end surface of each wheel body (2) is detachably connected with a fixed plate (21).

5. The fence frame according to claim 1, wherein a side edge of the connecting net (5) away from the framework (1) is provided with a plurality of first plugging buckles (51); and two side surfaces of the framework (1) are respectively provided with first plugging bayonets (13) matched with the first plugging buckles (51).

6. A fence system, comprising:

a fence frame; and a plurality of fence assembly units (7) arranged on the fence frame;

wherein the fence frame comprises a framework (1), wheel bodies (2) rotatably connected to two sides of a bottom of the framework (1), and a plurality of storage racks (3) movably arranged on an end surface of the framework (1), wherein a fixed net (4) is arranged in the framework (1), and one side wall of the framework (1) is provided with a connecting net (5);

the wheel bodies (2) are horizontally or vertically fixed on the bottom of the framework (1);

the plurality of fence assembly units (7) are detachably connected with the fence frame in sequence;

wherein each of the fence assembly units (7) comprises a base (74), a bar body (71) rotatably sleeved on a top of the base (74) and a net body (72) wound on the bar body (71);

an outer side edge of the net body (72) is provided with a plurality of second plugging buckles (73).

7. The fence system according to claim 6, wherein the top of the base (74) is provided with a winding apparatus (75); and the winding apparatus (75) drives the bar body (71) to rotate, so that the net body is wound on the bar body (71).

8. The fence system according to claim 6, wherein a side wall of the bar body (71) is provided with a plurality of second plugging bayonets (711) corresponding to the second plugging buckles (73).

9. A fence frame, comprising:

a framework (1), wheel bodies (2) rotatably connected to two sides of a bottom of the framework (1), and a plurality of storage racks (3) movably arranged on an end surface of the framework (1), wherein a fixed net (4) is arranged in the framework (1), and one side wall of the framework (1) is provided with a connecting net (5);

the wheel bodies (2) are horizontally or vertically fixed on the bottom of the framework (1);

the storage racks (3) are arranged symmetrically on two end surfaces of the framework (1);

wherein each of the storage racks (3) comprises a crossbeam plate (31) fixed on the end surface of the framework (1) and a storage plate (32) rotatably connected to the outer side surface of the crossbeam plate (31);

the side surface of the crossbeam plate (31) is provided with a carrier plate (33) located below the storage plate (32);

the storage plate (32) is provided with a plurality of storage holes (34).

* * * * *